US006869346B2

(12) United States Patent
Wendt et al.

(10) Patent No.: US 6,869,346 B2
(45) Date of Patent: Mar. 22, 2005

(54) RECEPTACLE FOR GRINDER TOOLS

(75) Inventors: Dieter Wendt, Leinfelden-Echterdingen (DE); Harald Krondorfer, Ludwigsburg (DE); Ralph Dammertz, Stuttgart (DE); Markus Heckmann, Filderstadt (DE); Joachim Schadow, Dettenhausen (DE); Thomas Schomisch, Leinfelden-Echterdingen (DE); Marco Brancato, Oberdorf (CH); Christof Hoelzl, Schwaz (AT); Johann Huber, Kramsach (AT); Wilhelm Schulze, Vomp (AT)

(73) Assignees: Robert Bosch GmbH, Stuttgart (DE); Tyrolit Schleifmittel Swarovski K.G., Weihingen (DE)

( * ) Notice: Subject to any disclaimer, the term of this patent is extended or adjusted under 35 U.S.C. 154(b) by 0 days.

(21) Appl. No.: 09/980,990

(22) PCT Filed: Mar. 31, 2001

(86) PCT No.: PCT/DE01/01275

§ 371 (c)(1),
(2), (4) Date: Mar. 1, 2002

(87) PCT Pub. No.: WO01/76823

PCT Pub. Date: Oct. 18, 2001

(65) Prior Publication Data

US 2003/0129933 A1 Jul. 10, 2003

(30) Foreign Application Priority Data

Apr. 7, 2000 (DE) ..... 100 17 457

(51) Int. Cl.[7] ..... B24B 41/00

(52) U.S. Cl. ..... 451/342; 451/359; 451/509; 451/517

(58) Field of Search ..... 451/342, 359, 451/508, 509, 517, 519, 548

(56) References Cited

U.S. PATENT DOCUMENTS

| | | | | | |
|---|---|---|---|---|---|
| 2,425,368 | A | | 8/1947 | Albert | |
| 2,480,886 | A | * | 9/1949 | Stever | 451/509 |
| 2,747,343 | A | * | 5/1956 | Gellert | 451/342 |
| 2,781,618 | A | * | 2/1957 | Larson | 451/509 |
| 2,789,402 | A | * | 4/1957 | Tocci-guilbert et al. | 451/509 |
| 2,800,751 | A | * | 7/1957 | Bruckner | 451/509 |
| 3,149,442 | A | * | 9/1964 | MacKay, Jr. et al. | 451/509 |
| 3,157,010 | A | * | 11/1964 | Block | 451/509 |
| 3,158,972 | A | * | 12/1964 | MacKay, Jr. et al. | 451/509 |
| 3,266,200 | A | * | 8/1966 | Block | 451/509 |
| 3,270,467 | A | * | 9/1966 | Block et al. | 451/509 |
| 3,270,468 | A | * | 9/1966 | Block et al. | 451/509 |
| 3,491,494 | A | * | 1/1970 | MacKay, Jr. | 451/509 |
| 3,623,281 | A | * | 11/1971 | Moffat | 451/509 |

(List continued on next page.)

FOREIGN PATENT DOCUMENTS

| | | | | |
|---|---|---|---|---|
| DE | 15 77 422 A | | 4/1970 | |
| DE | 3520417 A1 | * | 12/1986 | B24B/45/00 |
| EP | 0 904 896 A2 | | 3/1999 | |
| FR | 2 235 586 A | | 1/1975 | |

*Primary Examiner*—M. Rachuba
(74) *Attorney, Agent, or Firm*—Michael J. Striker

(57) ABSTRACT

The invention is based on a tool receiver for a grinder, in particular for a handheld angle grinder (10), having a carrier device (12, 14, 16, 182, 184, 300), via which an application tool (18, 32, 186, 188) can be actively connected to a drive shaft (54).

It is proposed that the application tool (18, 32, 186, 188) be actively connectable to the carrier device (14, 16, 182, 184) via at least one detent element (24, 26, 190, 192, 194, 196, 198, 200, 302) movable against a spring force that snaps into place in an operating position of the application tool (18, 32, 186, 188) and immobilizes the application tool (18, 32, 186, 188) with positive engagement.

16 Claims, 12 Drawing Sheets

U.S. PATENT DOCUMENTS 3,667,169 A * 6/1972 MacKay, Jr. ..... 451/511
3,683,567 A * 8/1972 Ali ..... 451/490
4,245,438 A * 1/1981 van Buren, Jr. ..... 451/509
4,683,683 A * 8/1987 Block ..... 451/509
4,839,998 A * 6/1989 Block ..... 451/509
5,175,963 A * 1/1993 Schafer et al. ..... 451/342
5,388,942 A * 2/1995 Bonacina et al. ..... 411/432
5,619,770 A 4/1997 Bell
5,707,275 A * 1/1998 Preis et al. ..... 451/342
6,116,996 A 9/2000 Yanase

* cited by examiner

RECEPTACLE FOR GRINDER TOOLS

BACKGROUND OF THE INVENTION

The invention is based on a tool for a grinder.

A tool receiver for a grinder for a handheld angle grinder is made known in EP 0 904 896 A2. The angle grinder comprises a drive shaft that carries a thread on the tool side.

The tool receiver for a grinder comprises a carrier and a tensioning nut. To install a sanding disk, the carrier with an installation opening is pushed onto a collar of the drive shaft and tightened with positive engagement against a bearing surface via the tensioning nut. The carrier has a collar extending in the axial direction on the tool side that comprises radially-situated recesses on two opposite sides on its outer circumference that extend in the axial direction to a base of the collar. Starting at the recesses, one groove each extends around the outer circumference of the collar against the driving direction of the drive shaft. The grooves are closed against the driving direction of the drive shaft and taper axially starting at the recesses against the driving direction of the drive shaft.

The sanding disk comprises a hub having an installation opening in which two tongues point radially inward on opposite sides. The tongues can be inserted in the recesses in the axial direction and then in the grooves in the circumferential direction, against the driving direction. The sanding disk is immobilized in the grooves in the axial direction via the tongues with positive engagement and in the tapering contour of the grooves via non-positive engagement. During operation, the adhesion increases as a result of reaction forces acting on the sanding disk, which counteract the driving direction.

In order to prevent the sanding disk from spinning off of the carrier when the brake is applied to the drive shaft, a stopper is located in the vicinity of a recess on the circumference of the collar that is supported in an opening in a fashion that allows it to move in the axial direction. In a working position with the sanding disk pointing downward, the stopper is displaced axially in the direction of the sanding disk by means of the force of gravity, closes the groove in the direction of the recess, and blocks movement of the tongue located in the groove in the driving direction of the drive shaft.

SUMMARY OF THE INVENTION

The invention is based on a tool receiver for a grinder, in particular for a handheld angle grinder, having a carrier device via which an application tool can be actively connected to a drive shaft.

It is proposed that the application tool be actively connectable to the carrier device via at least one detent element movable against a spring force, which detent element snaps into an operating position of the application tool and immobilizes the application tool with positive engagement. Due to the positive engagement, a high degree of reliability can be achieved, and a simple and cost-effective, tool-free, rapid mounting system can be achieved. The application tool can be reliably prevented from spinning off, even when the brake is applied to the drive shaft, which can result in high brake torques.

The detent element can immobilize the application tool with positive engagement directly or indirectly via an additional component, for example, via a locking lever or plunger, etc. that is supported in a fashion that allows it to rotate and/or be displaced axially and is coupled to the detent element. The detent element can immobilize the application tool directly and/or indirectly with positive engagement in various directions, such as in the radial direction, in the axial direction, and/or, particularly advantageously, in the circumferential direction. It is also possible that, due to the positive fixation of the application tool with the detent element in a first direction, e.g, in the radial direction, the application tool is immobilized in a second direction with positive engagement by means of a component separated from the detent element.

The movable detent element can be designed in various forms appearing practical to one skilled in the art, e.g., as an opening, projection, peg, bolt, etc., and it can be located on the application tool or on the carrier device.

Moreover, an advantageous encoding can be achieved by means of the positive engagement, so that only specified application tools can be secured in the tool receiver for a grinder. The carrier device can be designed at least partially as a removable adapter part, or it can be connected with the drive shaft in non-detachable fashion due to a non-positive, positive, and/or bonded connection.

Various application tools appearing practical to one skilled in the art can be secured with the tool receiver for a grinder, such as application tools for separating, grinding, roughing, brushing, etc. A tool receiver according to the invention can also be used to secure a grinding plate of an eccentric grinding machine.

The spring force can be designed to act in various directions, such as in the circumferential direction or, particularly advantageously, in the axial direction, whereby a solution can be achieved that is simple in design. The spring force can further be used to immobilize the application tool in the circumferential direction as well as in the axial direction.

In a further embodiment of the invention it is proposed that a drive torque be transferrable via a positive connection between the application tool and the carrier device. A high drive torque can be transferred reliably, and a drive torque can be prevented from acting on a frictional connection.

As an advantage, the application tool can be connected to the carrier device via a carrier element located on the application tool and/or the carrier device and extending in the axial direction, that can be guided through at least one area of a slot of the corresponding counter-element, displaced along the slot, and immobilized in an end position by the detent element. Using the carrier element extending in the axial direction, a securing in the circumferential direction and the axial direction can be achieved, wherein the application tool is advantageously immobilized with positive engagement in the axial direction via a transfer surface of the carrier element. A high degree of reliability can be achieved and additional components, weight, mounting effort, and costs can be achieved.

In one embodiment it is proposed that the detent element be formed by an elastically deformable component, wherein additional spring elements are spared, and simple, cost-effective designs can be achieved.

Advantageously, at least one detent element producing the spring force is designed as an integral part of the tool hub of the application tool. The tool hub is usually produced out of a relatively thin material that can be designed with a simple construction that is elastically deformable. It is also feasible, however, that at least one spring element is designed as an integral part of a component of the carrier device, or it is formed by an additional component, wherein the tool hub can be designed independent of a spring function.

In order to make a large spring deflection of the tool hub possible, at least one recess is advantageously provided in a component of the carrier device forming a bearing surface for the application tool, into which a part of the tool hub is elastically pressed in an operating position of the application tool.

In a further embodiment of the invention it is proposed that the slot be provided in the tool hub of the application tool, and that at least one detent element be formed by a part of the tool hub in the vicinity of the slot; in fact, particularly advantageously, the slot comprises a wide area and at least one narrow area forming the detent element in front of an end position of the carrier element. Simple, cost-effective and, in particular, essentially flat tool hubs can be achieved that can be handled easily and in space-saving fashion during manufacture and subsequent storage without the tool hubs interlocking on top of each other or with other objects. In addition to a narrowed area, however, an axial raised part in the tool hub forming the detent element would also be feasible in principle.

It is further proposed that at least one detent element is supported in a fashion that allows it to move against a spring element. A large displacement of the detent element during mounting of the application tool can be achieved by means of the detent element supported in movable fashion, by way of which a large overlap between two corresponding detent elements and a particularly reliable positive connection can be achieved on the one hand and, on the other, a very audible snap-in noise can be achieved that signals to the user in advantageous fashion that the snap-in procedure was completed as desired.

The detent element can be designed to be movable in various directions against a spring element, such as in the circumferential direction or, particularly advantageously, in the axial direction, by way of which a simple design can be achieved.

The detent element can even be supported in movable fashion in a component in a bearing, e.g., in a flange of the carrier device or in a tool hub of the application tool. Advantageously, the detent element can also be firmly connected to a component supported in movable fashion in a bearing in non-positive, positive, and/or bonded fashion, or it can be designed integrally connected with this, e.g., with a component supported on the drive shaft or a tool hub of the application tool.

If the detent element can be released from its locked position using a release button and, in particular, if it is movable against the spring element, the snap-in connection can be reliably prevented from coming loose, e.g., by means of brake torque, and safety can be increased. Operation of the application tool in two circumferential directions can be made possible in principle, and comfort during installation and removal of the application tool can be increased.

If the application tool is connected to the carrier device in the circumferential direction via at least a first element and, in the axial direction via at least a second element, simple and cost-effective tool hubs can be achieved that can advantageously be designed flat in shape. An interlocking of the tool hubs during manufacture and storage can be prevented, and good handling of the application tool with its tool hubs can be achieved. Moreover, the components can be advantageously designed for their function, i.e., either for immobilization in the circumferential direction or immobilization in the axial direction. The elements can be formed by a component or, advantageously, by separate components. The tool hubs can be designed simply and advantageously with a closed centering hole, and a low-vibration movement of the application tool can be achieved. Moreover, by selecting a suitable diameter for the centering hole, it can be ensured that application tools provided for the tool receiver for a grinder according to the invention can be secured to traditional grinders via heretofore known fastening devices, and, in fact, via fastening devices in particular with which the application tool can be immobilized on the drive shaft with a tensioning nut and a tensioning flange against a bearing surface in the axial direction with positive engagement and, in the circumferential direction, via non-positive connection.

Moreover, at least one detent element extending in the axial direction can advantageously be snapped into place in a recess of a tool hub of the application tool corresponding to the detent element in an operating position of the application tool in the axial direction, and the application tool can be immobilized with positive engagement in the circumferential direction. Using a means of attaining the object of the invention having a simple design, an advantageous positive connection can be achieved in a circumferential direction and, preferably, in both circumferential directions. The detent element extending in the axial direction can be formed by a separate bolt or an integrally-moulded peg that is produced by means of a deep-drawing procedure, etc.

If at least one detent element is integrally-moulded to a discoid component and/or if at least two elements for immobilizing the application tool in the axial direction are integrally-moulded to a discoid component, additional components, mounting effort, and costs can be spared. Moreover, compression connections between individual components and weak points resulting therefrom can be avoided.

BRIEF DESCRIPTION OF THE DRAWINGS

Further advantages result from the following drawing description. Exemplary embodiments of the invention are presented in the drawing. The drawing, the description, and the claims contain numerous features in combination. One skilled in the art will also advantageously consider the features individually and combine them into further practical combinations.

DESCRIPTION OF THE PREFERRED EMBODIMENTS

Figure 1:
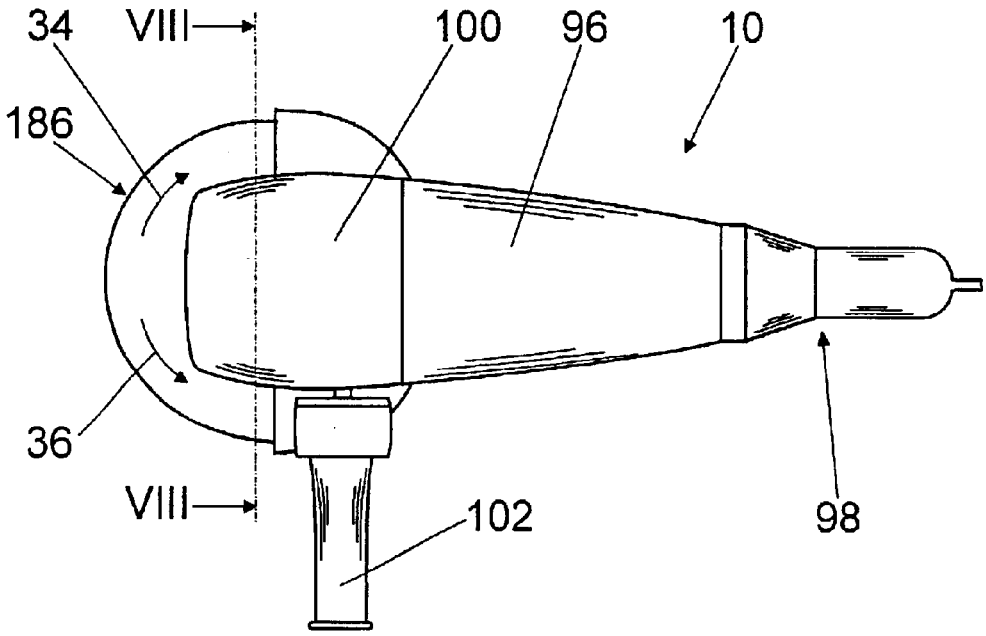
FIG. 1 is an angle grinder shown from above.

FIG. 1 shows an angle grinder 10 from above having an electric motor—not shown in greater detail—located in a housing 96. The angle grinder 10 can be guided via a first handle 98 extending in the longitudinal direction and integrated in the housing 96 opposite to a cutoff wheel 18 and via a second handle 102 extending at an angle to the longitudinal direction secured to a drive housing 100 in the vicinity of the cutoff wheel 186.

Figure 2:
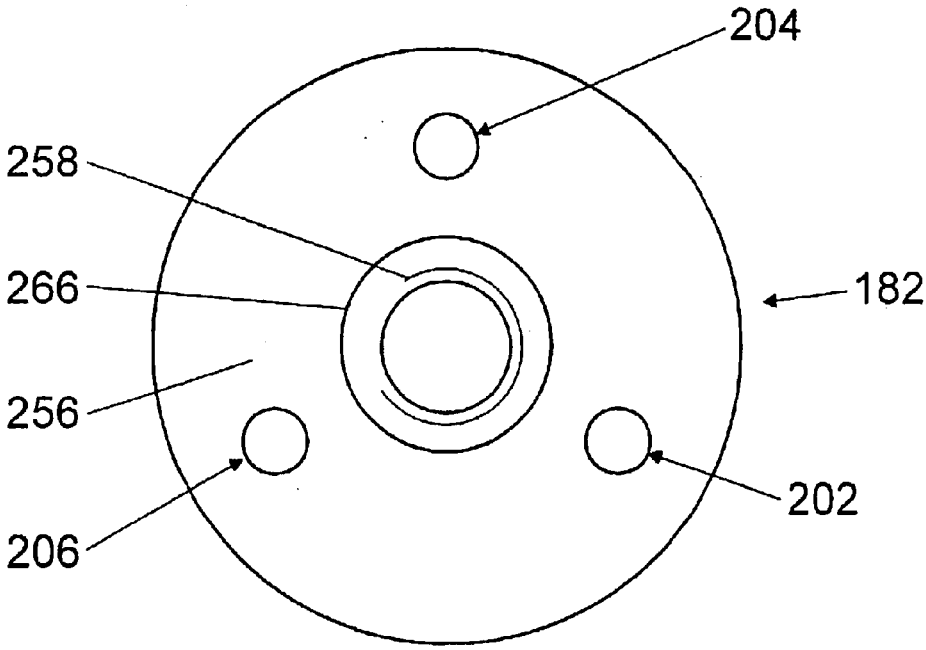
FIG. 2 is a driving flange shown from below.
Figure 3:
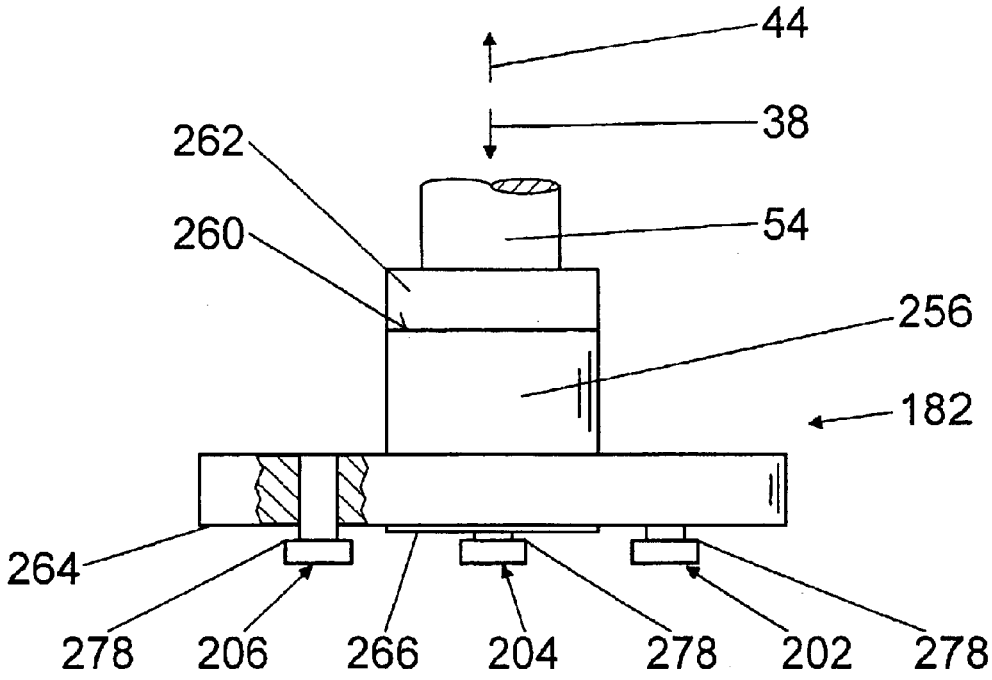
FIG. 3 is the driving flange in FIG. 2 shown in a side view.

Using the electric motor, a drive shaft 54 can be driven via a gear mechanism, not shown in greater detail, on its end pointing toward the cutoff wheel 186 of which a carrier device 182 is located (FIGS. 2 and 3).

The carrier device 182 comprises a driving flange 256. The driving flange 256 is screwed into place on the drive shaft 54 via a thread 258 and, with a face 260 pointing in the direction 44 opposite to the cutoff wheel 186, extends to a collar 262 on the drive shaft 54. It would also be possible to connect a driving flange with a drive shaft in non-detachable fashion, or to design it integrated with a drive shaft. Three driving pins 202, 204, 206 are pressed into the driving flange 256 that extend in the axial direction 38 over an axial bearing surface 264 of the driving flange 256 for the cutoff wheel 186, and that are evenly spaced in the circumferential direction. Heads are integrally-moulded on the driving pins 202, 204, 206 on the ends pointing toward the cutoff wheel 186. The head has a larger diameter than the remaining part of the driving pin 202, 204, 206 and forms a support surface 278 in the direction of the driving flange 256. A centering hole 266 for the cutoff wheel 186 extending in the axial direction 38 is integrally-moulded in the bearing surface 264.

Figure 4:
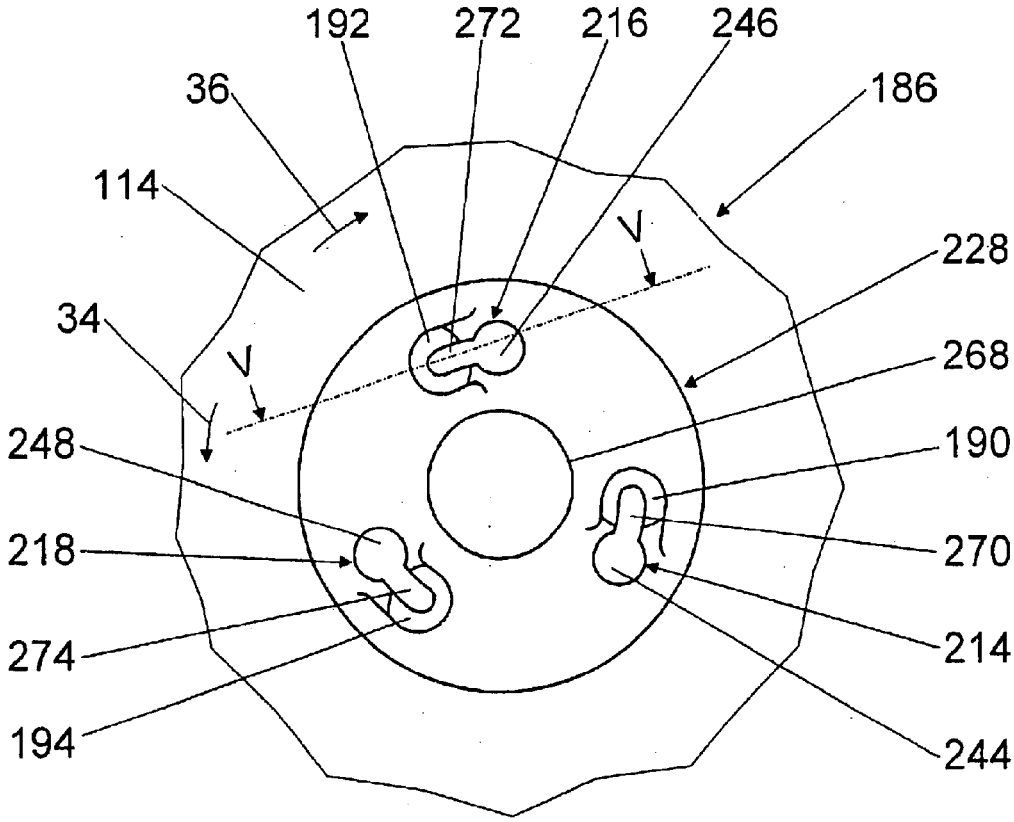
FIG. 4 is a tool hub of a cutoff wheel shown from below.
Figure 5:
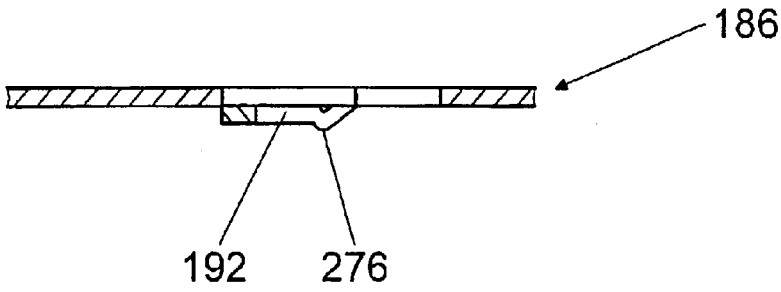
FIG. 5 is an enlarged view along the line V—V in FIG. 4.

The cutoff wheel 186 comprises a sheet-metal hub 228 (FIG. 4). The sheet-metal hub 228 comprises a centering hole 268, via which the cutoff wheel 186 can be centered on the centering collar 266 of the driving flange 256. The sheet-metal hub 228 is connected and pressed to a grinding means 114 via a riveted joint, which is not shown in greater detail. The sheet-metal hub 228 comprises three slots 214, 216, 218 evenly spaced in the circumferential direction 34, 36, each of which comprises a wide area 244, 246, 248 produced by means of a bore hole, and a narrow area 270, 272, 274 extending in the circumferential direction 36.

A part of the sheet-metal hub 228 is designed as a spring shackle on one end of the slot 214, 216, 218 opposite to the wide area 244, 246, 248, which spring shackle forms a detent element 190, 192, 194. Instead of spring shackles integrally-moulded to the sheet-metal hub 228, spring-mounted driving pins could also be attached to the driving flange.

When the cutoff wheel 186 with its sheet-metal hub 228 is placed on the driving flange 256, the heads of the driving pins 202, 204, 206 are inserted through the wide areas 244, 246, 248 of the slots 214, 216, 218. The sheet-metal hub 228 is oriented with its centering hole 268 over the centering flange 266. By rotating the sheet-metal hub 228 relative to the driving flange 256 against the driving direction 34, the spring shackles or the detent elements 190, 192, 194 move under the heads of the driving pins 202, 204, 206. The direction of rotation 36 for securing the cutoff wheel 186 is opposite to the driving direction 34 of the drive shaft 54. This ensures that the cutoff wheel 186 does not unintentionally come loose during operation. The heads of the driving pins 202, 204, 206 glide over the lugs 276 of the spring shackles or the detent elements 190, 192, 194 when rotated, and displace them in the axial direction 44 toward the driving flange 256. When the heads have passed the lugs 276 or an operating position of the cutoff wheel 186 has been reached, the spring shackles spring back partially in the axial direction 38 and grip behind the heads with positive engagement. A snap-in noise produced thereby can serve to ensure the operator that the sheet-metal hub 228 is locked in place as desired. A remaining tension or spring force of the spring shackles presses the cutoff wheel 186 against the bearing surface 264 without play in the axial direction 44.

The drive torque of the electric motor is transferred from the driving flange 256 with positive engagement via the driving pins 202, 204, 206 and via the spring shackles or via the detent elements 190, 192, 194 to the sheet-metal hub 228. A brake torque that is produced and opposes the drive torque is transferred with positive engagement from the heads of the driving pins 202, 204, 206 via the lugs 276 of the detent elements 190, 192, 194 to the sheet-metal hub 228, and with frictional engagement from the bearing surface 264 to a corresponding bearing surface of the sheet-metal hub 228. The magnitude of the friction force thereby depends on the surface condition of the two bearing surfaces 264 and a clamping force of the spring shackles, and can be adjusted accordingly via these parameters. The cutoff wheel 186 is reliably prevented from spinning off. So as to transfer particular high brake torques, a Velcro connection or another type of positive-engagement connection can be created between the bearing surfaces, for example.

To remove the cutoff wheel 186, the cutoff wheel 186 is rotated in the driving direction 34 relative to the driving flange 256 so that the heads of the driving pins 202, 204, 206 glide over the lugs 276 of the detent elements 190, 192, 194. When the driving pins 202, 204, 206 come to rest in the wide areas 244, 246, 248 of the slots 214, 216, 218, the cutoff wheel 186 can be removed from the driving flange 256 in the axial direction 38.

Figure 6:
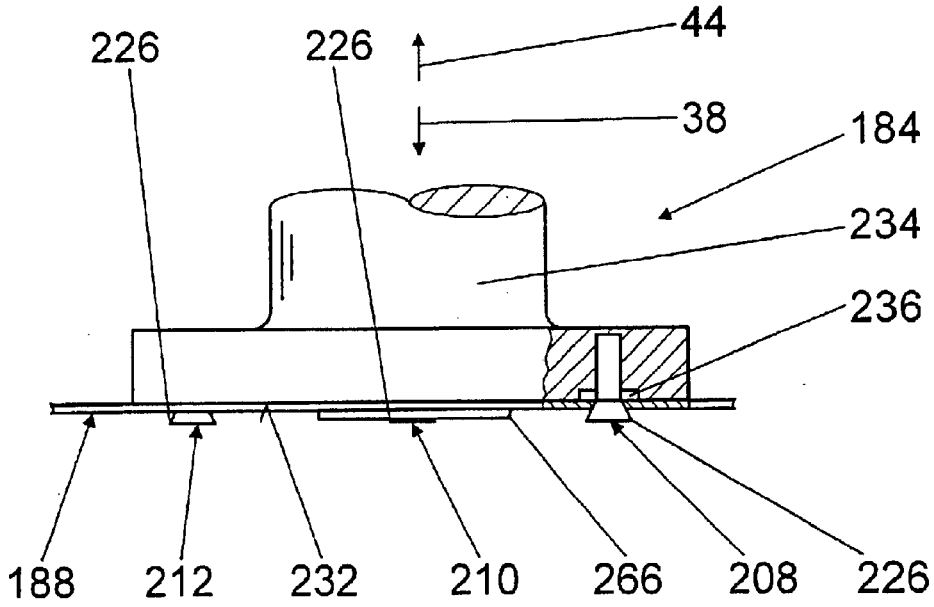
FIG. 6 is a variant of FIG. 3.
Figure 7:
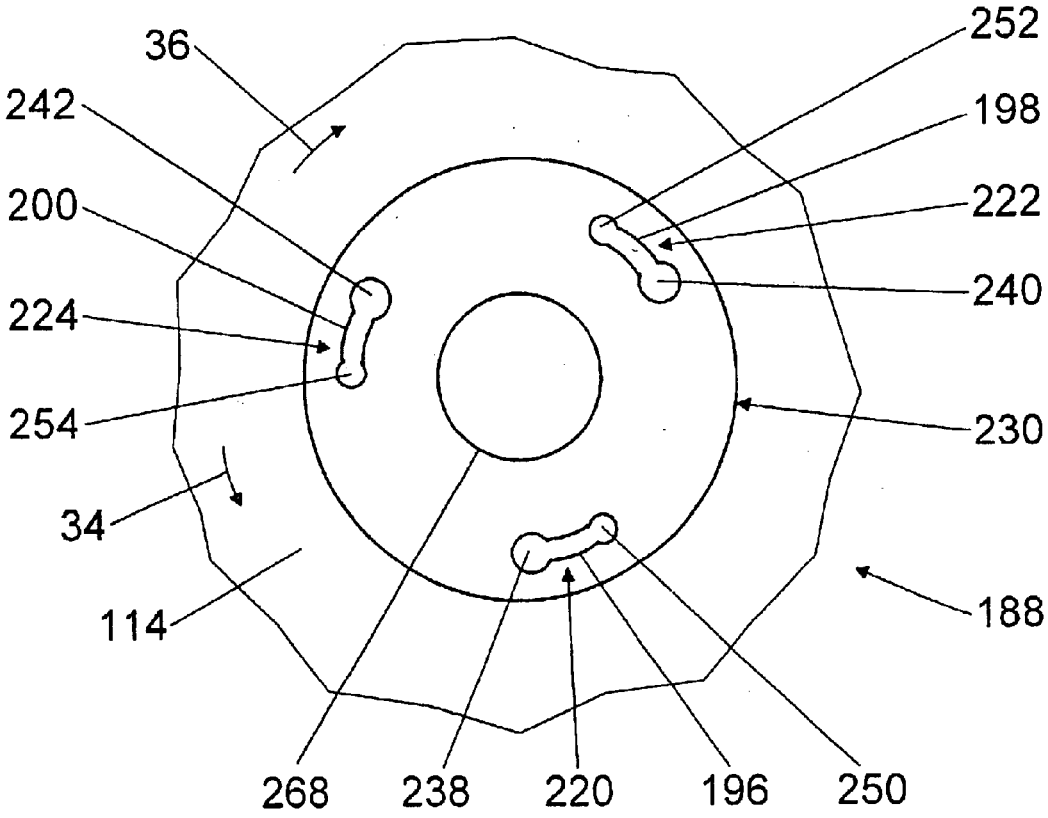
FIG. 7 is a variant of FIG. 4.

An alternative carrier device 184 having a corresponding cutoff wheel 188 is shown in FIGS. 6 and 7. Components that essentially remain the same are basically labelled with the same reference numerals in the exemplary embodiments shown. Moreover, the description of the exemplary embodiment in FIGS. 1 through 5 can be referred to for the exemplary embodiment in FIGS. 6 and 7.

The carrier device 184 comprises a driving flange 234. Three driving pins 208, 210, 212 are pressed into the driving flange 234, which extend in the axial direction 38 over an axial bearing surface 232 of the driving flange 234 for the cutoff wheel 188, and are spaced evenly in the circumferential direction 34, 36. Heads are integrally-moulded with the driving pins 208, 210, 212 on their ends pointing toward the cutoff wheel 188. The head has a larger diameter than the remaining part of the driving pin 208, 210, 212 and forms a conical, tapering transfer surface 226 in the axial direction 44 toward the driving flange 234. Recesses 236 are provided in the bearing surface 232 in the vicinity of the driving pins 208, 210, 212.

The cutoff wheel 188 comprises a sheet-metal hub 230 (FIG. 7). The sheet-metal hub 230 comprises a centering hole 268, via which the cutoff wheel 188 can be centered on a centering collar 266 of the driving flange 234. The sheet-metal hub 230 is connected and pressed to a grinding means 144 via a riveted joint, which is not shown in greater detail. The sheet-metal hub 230 contains three slots 220, 222, 224 evenly spaced in the circumferential direction 34, 36, each of which comprises a wide area 238, 240, 242 produced by means of a bore hole, and a narrow area, each of which forms a detent element 196, 198, 200, in front of an end position 250, 252, 254 of the driving pins 208, 210, 212.

When the cutoff wheel 188 with its sheet-metal hub 230 is placed on the driving flange 234, the heads of the driving pins 208, 210, 212 are inserted through the wide areas 238, 240, 242 of the slots 220, 222, 224. The sheet-metal hub 230 is oriented with its centering hole 268 over the centering collar 266. When the sheet-metal hub 230 is rotated against the driving direction 24 relative to the driving flange 234, the driving pins 208, 210, 212 move in the curved slots 220, 222, 224. The direction of rotation 36 for securing the cutoff wheel 188 is opposite to the driving direction 34 of the drive shaft 54. This ensures that the cutoff wheel 188 does not unintentionally come loose during operation.

When the sheet-metal hub 230 is rotated, the heads of the driving pins 208, 210, 212 glide with their conical transfer surfaces 226 over the narrowed areas or over the detent elements 196, 198, 200 of the slots 220, 222, 225, each of them thereby pressing part of the sheet-metal hub 230 axially in the recesses 236 of the bearing surface 232 of the driving flange 234 provided for this in the vicinity of the slots 220, 222, 224 in the direction 44 of the driving flange 234. When the cutoff wheel 188 has reached an operating position, or when the driving pins 208, 210, 212 have reached their end position 250, 252, 254 having a width slightly larger than the middle area of the slots 220, 222, 224, the detent elements 196, 198, 200 snap into place behind the heads of the driving pins 208, 210, 212 with positive engagement. In the end positions 250, 252, 254, the sheet-metal hub 230 is displaced elastically by a defined amount by the conical transfer surfaces 226 of the driving pins 208, 210, 212. A remaining elastic clamping force of the sheet-metal hub 230 presses this against the bearing surface 232. The sheet-metal hub 230 is secured without play in the axial direction 38, 44 with positive engagement.

The drive torque of the electric motor is transferred from the driving flange 234 with positive engagement via the driving pins 208, 210, 212 at the end of the slots 220, 222, 224 to the sheet-metal hub 230. A brake torque that is produced and opposes the drive torque is transferred with positive engagement from the heads of the driving pins 208, 210, 212 via the detent elements 196, 198, 200 to the sheet-metal hub 230, and with frictional engagement from the bearing surface 232 to a corresponding bearing surface of the sheet-metal hub 230. The magnitude of the friction force thereby depends on the surface condition of the two bearing surfaces 232 and a clamping force of the detent elements 196, 198, 200, and can be adjusted accordingly via these parameters. The cutoff wheel 186 is reliably prevented from spinning off.

To remove the cutoff wheel 188, the cutoff wheel 188 is rotated in the driving direction 34 relative to the driving flange 234 so that the heads of the driving pins 208, 210, 212 glide over the detent elements 196, 198, 200. When the driving pins 208, 210, 212 come to rest in the wide areas 238, 240, 242 of the slots 220, 222, 224, the cutoff wheel 188 can be removed from the driving flange 234 in the axial direction 38.

Figure 8:
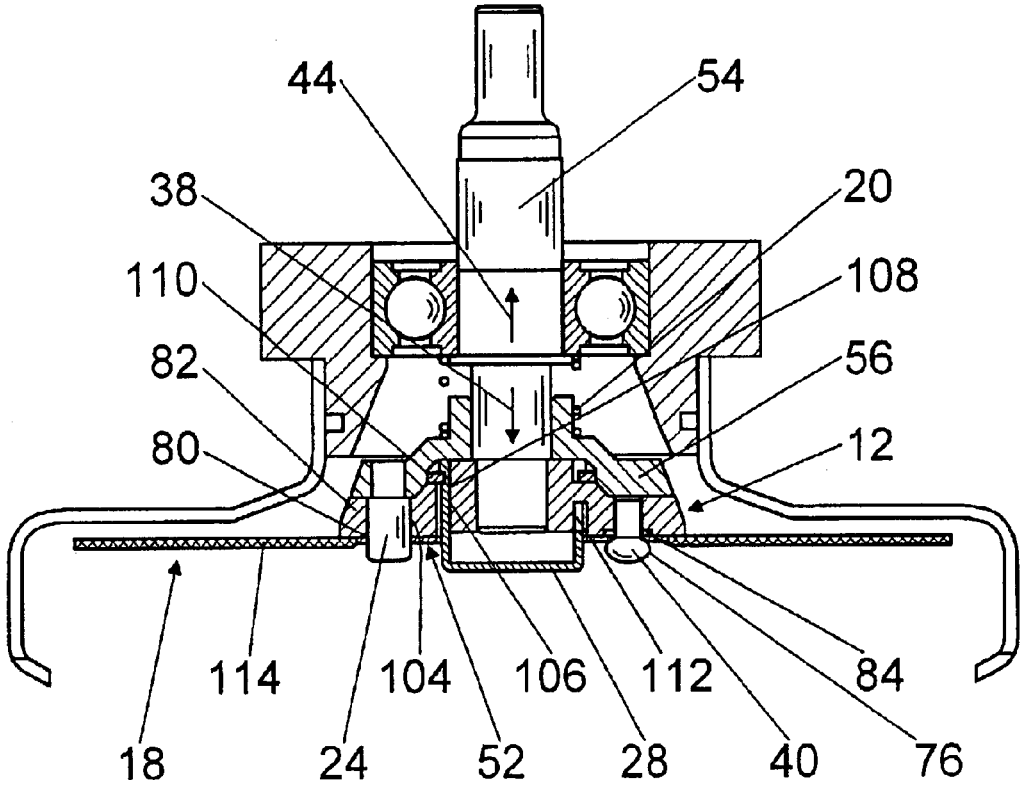
FIG. 8 is a sectional view along the line VIII—VIII in FIG. 1 through an alternative carrier device.

FIG. 8 shows a sectional view along the line VIII—VIII in FIG. 1 through a carrier device 12 that is an alternative to FIG. 2. The carrier device 12 comprises a driving flange 82 pressed solidly to a side of a drive shaft 54 facing a cutoff wheel 18 and a driving disk 56 supported on the drive shaft 54 in such a fashion that it can be displaced axially against a coil spring 20 located in the center.

Three pins 40 are pressed into the driving flange 82 that extend in the axial direction 38 toward the cutoff wheel 18 over the driving flange 82 and that are evenly spaced in the circumferential direction 34, 36. Each of the pins comprises a head on its end pointing toward the cutoff wheel 18 that has a larger diameter compared to a remaining part of the pin 40, and, on a side facing the driving flange 82, a conical support surface 76 tapering in the axial direction 44. The driving flange 82 forms an axial bearing surface 80 for the cutoff wheel 18 that establishes an axial position of the cutoff wheel 18 and in which recesses 84 are provided in the vicinity of the pins 40. Moreover, three axial through holes 104 are provided in the driving flange 82 that are evenly spaced in the circumferential directin 34, 36; in fact, one through hole 104 each is located between two pins 40 in the circumferential direction.

Three bolts 24 are pressed in the driving disk 56 supported on the drive shaft 54 in axially displaceable fashion, which extend in the axial direction 38 toward the cutoff wheel 18 over the driving disk 56 and are evenly spaced in the circumferential direction 34, 36. The driving disk 56 is pressed against the driving flange 82 by the coil spring 20 in the direction 38 toward the cutoff wheel 18. The bolts 24 extend through the through holes 104 and extend in the axial direction 38 over the driving flange 82.

Moreover, the carrier device 12 comprises a release button 28 designed in the shape of a pot, located in the middle, on the side facing the cutoff wheel 18. The release button 28 comprises three segments 106 evenly spaced in the circumferential direction 34, 36 and extending in the axial direction 44 toward the axially movable driving disk 56 that grip through corresponding recesses 108 of the driving flange 82 and are connected to the driving disk 56 in the axial direction 38 via a circlip 110 secure the release button 28 from falling out. The release button 28 is inserted in displaceable fashion into a ring-shaped recess 112 in the driving flange 82 in the axial direction 38, 44.

Figure 9:
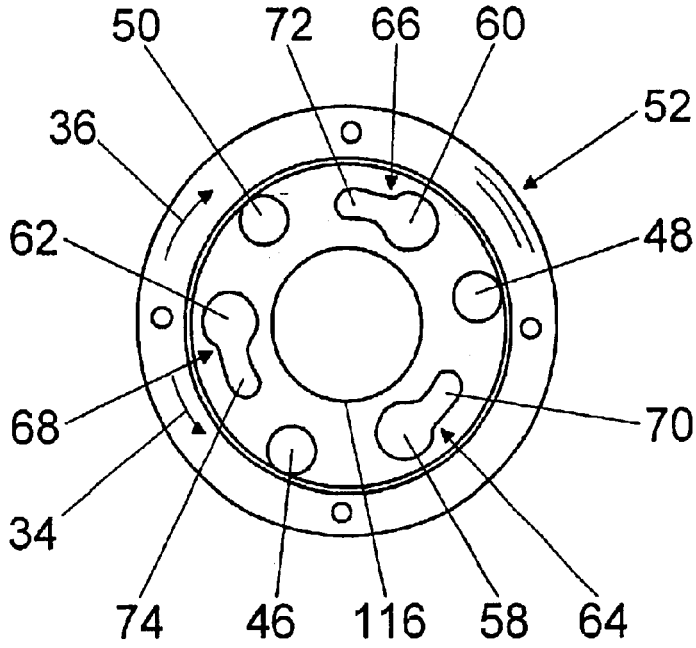
FIG. 9 is a tool hub shown from below.

The cutoff wheel 18 comprises a sheet-metal hub 52 that is solidly connected and pressed to a grinding means 114 via a riveted joint which is not shown in greater detail (FIG. 9). The tool hub could also be produced out of another material appearing practical to one skilled in the art, such as plastic, etc. The sheet-metal hub 52 comprises three sequential holes 46, 48, 50 in the circumferential direction 34, 36, the diameter of which is slightly greater than the diameter of the bolts 24. Moreover, the sheet-metal hub 52 comprises three slots 64, 66, 68 located in sequence in the circumferential direction 34, 36 and extending in the circumferential direction 34, 36, each of which comprises a narrow area 70, 72, 74 and a wide area 58, 60, 62 produced by means of a bore hole, the diameter of which is slightly larger than the diameter of the heads of the pins 40.

The sheet-metal hub 52 comprises a centering hole 116, the diameter of which is advantageously selected so that the cutoff wheel 18 can also be mounted on a traditional angle grinder using a traditional mounting system with a mounting flange. A "downward compatibility" is ensured.

When mounting the cutoff wheel 18, the cutoff wheel 18 is slid with its centering hole 116 onto the release button 28 and centered radially. The cutoff wheel 18 is then rotated until the pins 40 grip in the wide areas 58, 60, 62 of the slots 64, 66, 68 of the sheet-metal hub 52 provided for this. By pressing the sheet-metal hub 52 against the bearing surface 80 of the driving flange 82, the bolts 24 in the through holes 104 and the driving disk 56 are displaced against a spring force of the coil spring 20 on the drive shaft 54 axially in the direction 44 opposite to the cutoff wheel 18.

Rotating the sheet-metal hub 52 further against the driving direction 34 displaces the pins 40 in the curved narrow areas 70, 72, 74 of the slots 64, 66, 68. The pins 40 thereby press with their conical support surfaces 76 on the edges of the slots 64, 66, 68, and press them elastically into the recesses 84 of the driving flange 82. The sheet-metal hub 52 is thereby pressed against the bearing surface 80 and immobilized in the axial direction 38, 44.

In a final operating position of the cutoff wheel 18, the holes 46, 48, 50 come to rest in the sheet-metal hub 52 via the through holes 104 of the driving flange 82.

The bolts 24 are displaced axially in the direction 38 of the cutoff wheel 18 by means of the spring force of the coil spring 20, snap into place in the holes 46, 48, 50 of the sheet-metal hub 52, and immobilize them with positive engagement in both circumferential directions 34, 36. When they snap into place, a snap-in noise audible to the operator is produced which signals to the operator that the tool is ready to use.

A drive torque of the electric motor of the angle grinder 10 can be transferred to the cutoff wheel 18 from the drive shaft 54 to the driving flange 82 with non-positive engagement, and from the driving flange 82 via the bolts 24 with positive engagement. The drive torque is transferred exclusively via the bolts 24, because the slots 64, 66, 68 are designed so that the pins 40 do not come to rest at the narrow end 70, 72, 74 of the slots when the bolts 24 are snapped into place. Moreover, a brake torque occurring during and after the electric motor is switched off and that is opposed to the drive torque can be transferred with positive engagement by the driving flange 82 to the cutoff wheel 18 via the bolts 24. The cutoff wheel 18 is reliably prevented from unintentionally coming loose. An advantageous, even distribution of forces and mass is achieved by means of the three bolts 24 evenly spaced in the circumferential direction 34, 36.

The release button 28 is pressed to release the cutoff wheel 18 from the angle grinder 10. The driving disk 56 is thereby displaced with the bolts 24 via the release button 28 against the coil spring 20 in the axial direction 44 opposite to the cutoff wheel 18, whereby the bolts 24 move in the axial direction 44 out of their locked position or out of the holes 46, 48, 50 of the sheet-metal hub 52. The cutoff wheel 18 is then rotated in the driving direction 34 until the pins 40 come to rest in the wide areas 58, 60, 62 of the slots 64, 66, 68 and the cutoff disk 18 can be removed from the driving flange 82 in the axial direction 38. After the release button 28 is released, the driving disk 56, the bolts 24, and the release button 28 are pushed back to their initial positions by means of the coil spring 20.

Figure 10:
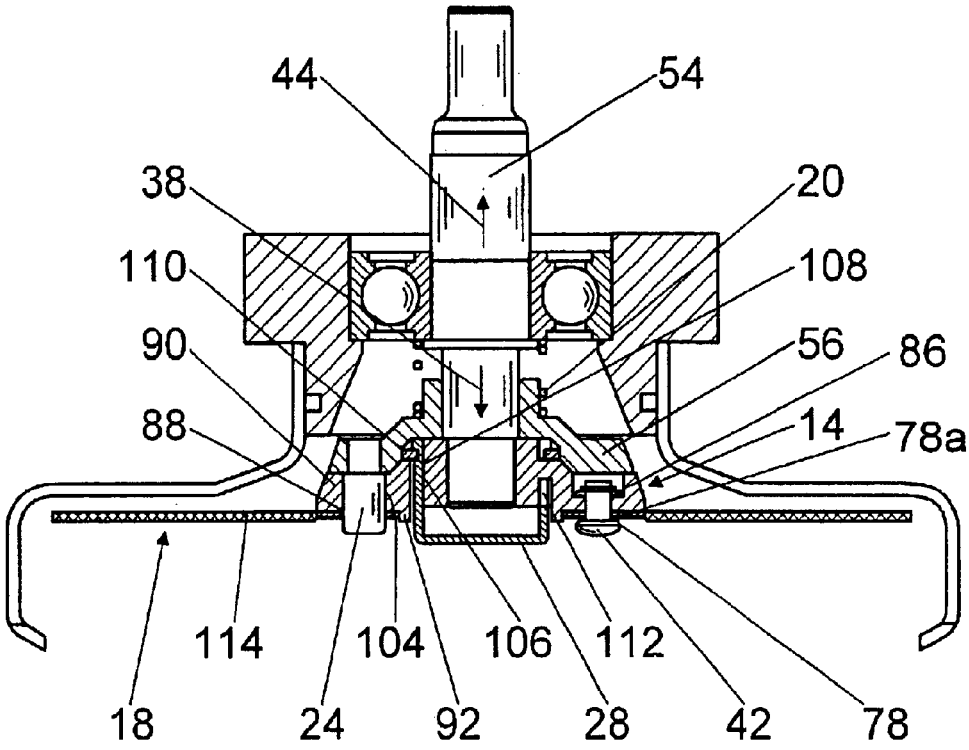
FIG. 10 is a variant of FIG. 8.

An exemplary embodiment with a carrier device 14 that is an alternative to the exemplary embodiment in FIG. 8 is shown in FIG. 10. FIGS. 8 and 9 can be referred to with regard for features and functions that remain the same.

The carrier device 14 comprises a driving flange 90 pressed onto the drive shaft 54. A collar 92 is integrally-moulded to a driving flange 90 forming a bearing surface 88 for the cutoff wheel 18, via which collar 92 the cutoff wheel 18 is centered radially in its state with the centering hole 116 mounted. Radial forces can be advantageously absorbed by the driving flange 90 without stressing the release button 28.

In order to immobilize the cutoff wheel 18, moreover, three pins 42 spaced evenly in sequence in the circumferential direction 34, 36 and extending in the axial direction 38 over the bearing surface 88 are supported in the driving flange 90 in a fashion that allows them to be displaced in the axial direction 38 against one disk spring 86 in each case. Each of the pins 42 comprises a head on its end pointing toward the cutoff wheel 18 that has a larger diameter than a remaining portion of the pin 42 and has a conical transfer surface 78 tapering in the axial direction 44 on a side facing the driving flange 90, and a support surface **78*a* extending in parallel to the bearing surface 88. When the heads of the pins 42 are inserted through the wide areas 58, 60, 62 of the slots 64, 66, 68, rotating the sheet-metal hub 52 against the driving direction 34 causes the pins 42 to be displaced into the curved narrow areas 70, 72, 74 of the slots 64, 66, 68. The pins 42 are therefore displaced axially over the conical transfer surfaces 78 against the pressure of the disk spring 86 in direction 38 until the support surfaces 78*a* of the pins 42 overlap the edges of the slots 64, 66, 68 in the curved narrow areas 70, 72, 74**.

In the installed state, the disk springs 86 press the cutoff wheel 18 against the bearing surface 88 via the support surfaces **78*a* of the pins 42. Instead of a plurality of disk springs 86, the pins can also be loaded via a common spring element, e.g., via a disk spring extending over the entire circumference and not shown in greater detail. The exemplary embodiment shown in FIG. 10 having the pins 42** supported in axially displaceable fashion is suited in particular for thick and/or only slightly elastically deformable tool hubs.

FIGS. 11 through 18 show a further exemplary embodiment having a carrier device 16. The carrier device 16 comprises a driving flange 118 secured to a drive shaft—not shown in greater detail—via a thread 120 (FIG. 11, FIGS. 16, 17, and 18). The driving flange could also be designed connected to the drive shaft via a non-detachable connection, or it could be designed as an integral part with this.

Figure 16:
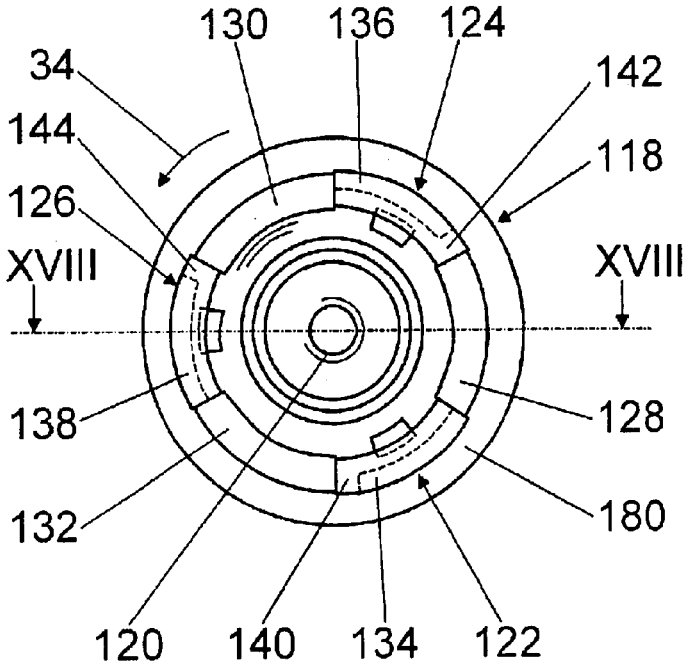
FIG. 16 is a carrier element from FIG. 11 shown from below.
Figure 17:
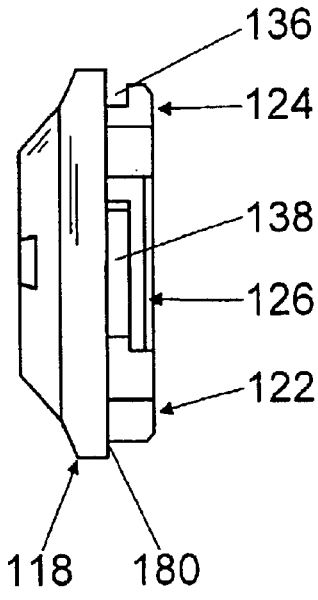
FIG. 17 is a carrier element from FIG. 16 shown from the side.
Figure 18:
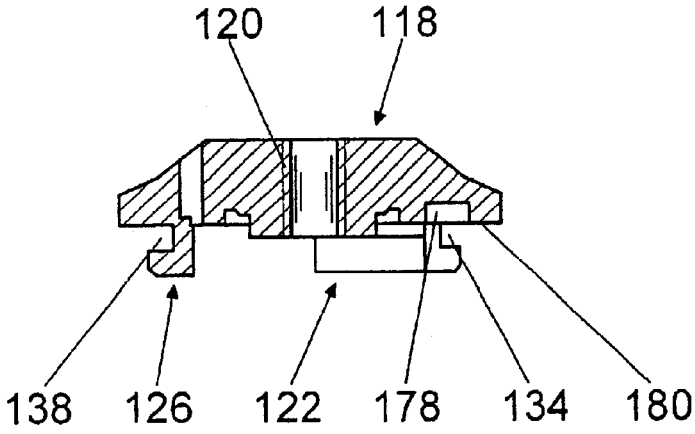
FIG. 18 is a sectional view along the line XVIII—XVIII in FIG. 16.

The driving flange 118 comprises three segments 122, 124, 126 and intermediate spaces 128, 130, 132 between them located in sequence in the circumferential direction 34, 36 and extending in the axial direction 38 to a cutoff wheel 32 (FIG. 16). Each of these segments 122, 124, 126 comprises a groove 134, 136, 138 on its circumference that is closed against the driving direction 34 in each case via a rotary stop 140, 142, 144 and is open in the driving direction 34. Moreover, the driving flange 118 comprises a bearing surface 180 that establishes an axial position of the cutoff wheel 32. Moreover, the segments 122, 124, 126 form a centering collar for the cutoff wheel 32, via which the cutoff wheel 32 can be centered.

Figure 11:
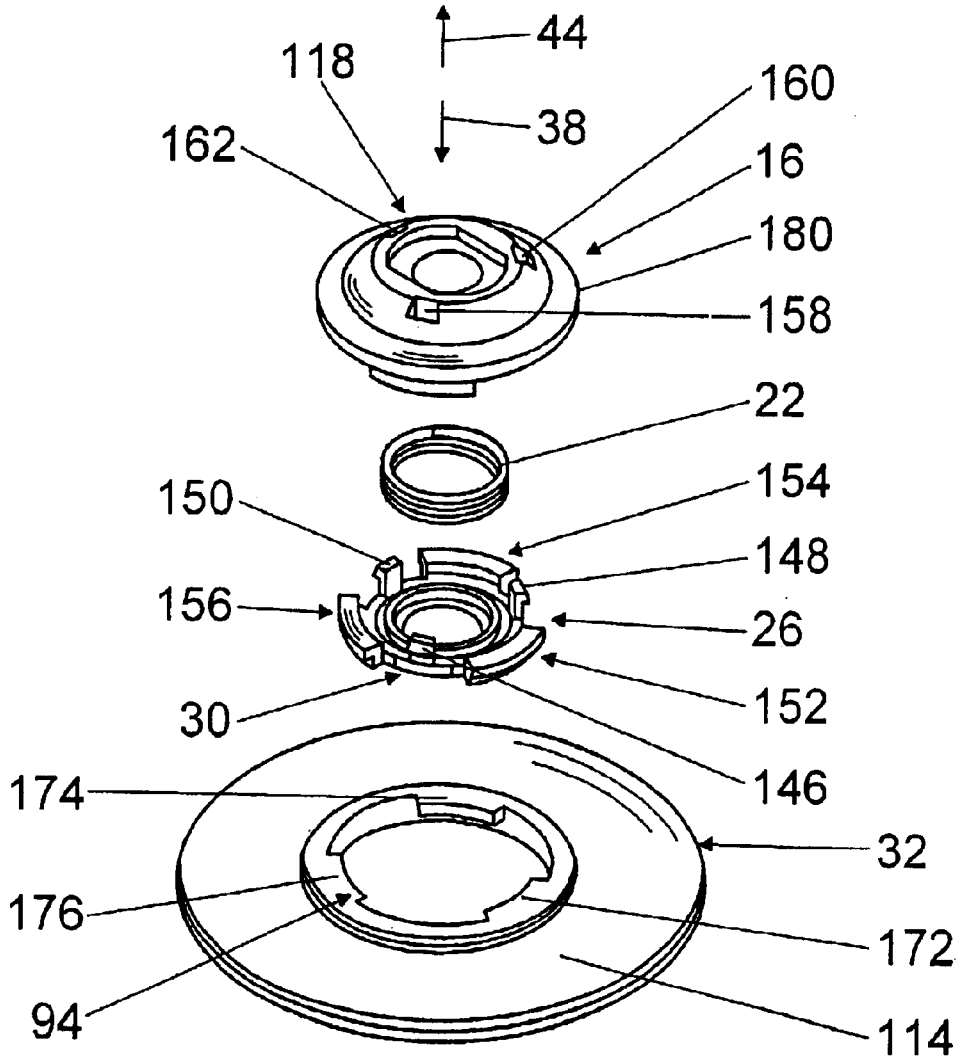
FIG. 11 is an exploded diagram of a variant of FIG. 8.
Figure 14:
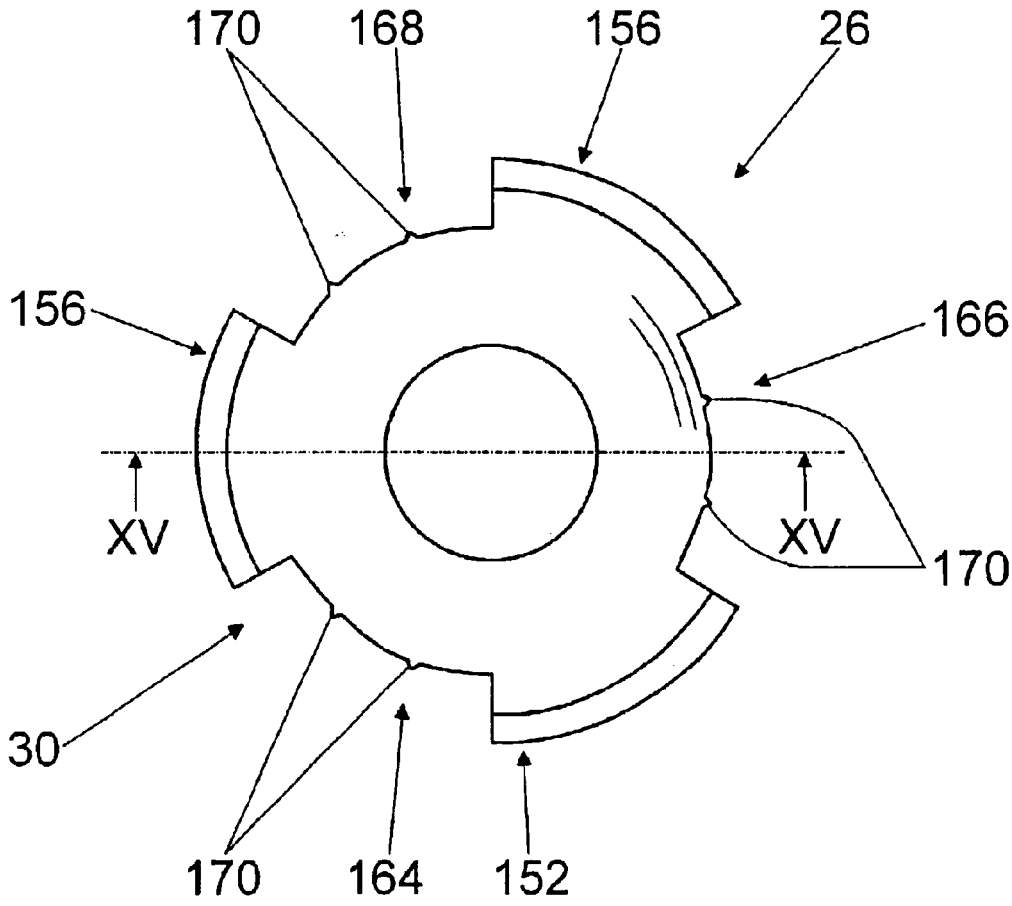
FIG. 14 is a release button from FIG. 11 shown from below.
Figure 15:
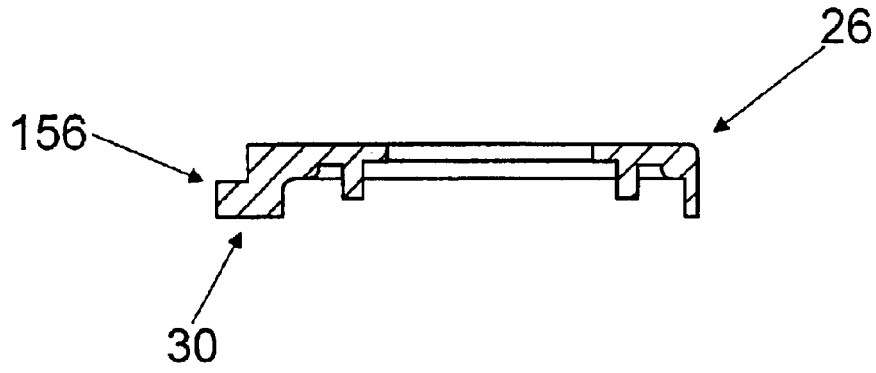
FIG. 15 is a sectional view along the line XV—XV in FIG. 14.

In the installed state, a detent element 26 is connected to the driving flange 118 via three snap-in pegs 146, 148, 150 spaced around the circumference, that grip through corresponding recesses 158, 160, 162 of the driving flange 118 and grip radially outward behind the driving flange 118 (FIGS. 11, 14, and 15). Three locking segments 152, 154, 156 located in sequence in the circumferential direction 34, 36 and extending radially outward are integrally-moulded to the detent element 26, which also forms a release button 30. A coil compression spring 22 is located between the driving flange 118 and the detent element 26, against which the detent element 26 can be displaced relative to the driving flange 118 in the axial direction 44 opposite to the cutoff wheel 32. The detent element 26 is thereby guided over radially outwardly-pointing bearing surfaces 164, 166, 168 between the locking segments 152, 154, 156 in radially inwardly-pointing surfaces of the segments 122, 124, 126 of the driving flange 118. To prevent the detent element 26 from tilting and to achieve small bearing surfaces 164, 166, 168, the bearing surfaces 164, 166, 168 are formed by projections 170 extending radially outward (FIG. 14).

In the installed state, the locking segments 152, 154, 156 are located in the intermediate spaces 128, 130, 132 of the driving flange 118 and extend radially over a groove bottom of the grooves 134, 136, 138. In an initial position before installation of the cutoff wheel 12, the locking segments 152, 154, 156 of the detent element 26 lie in front of the grooves 134, 136, 138, loaded by the preloaded coil compression spring 22, in fact.

Figure 12:
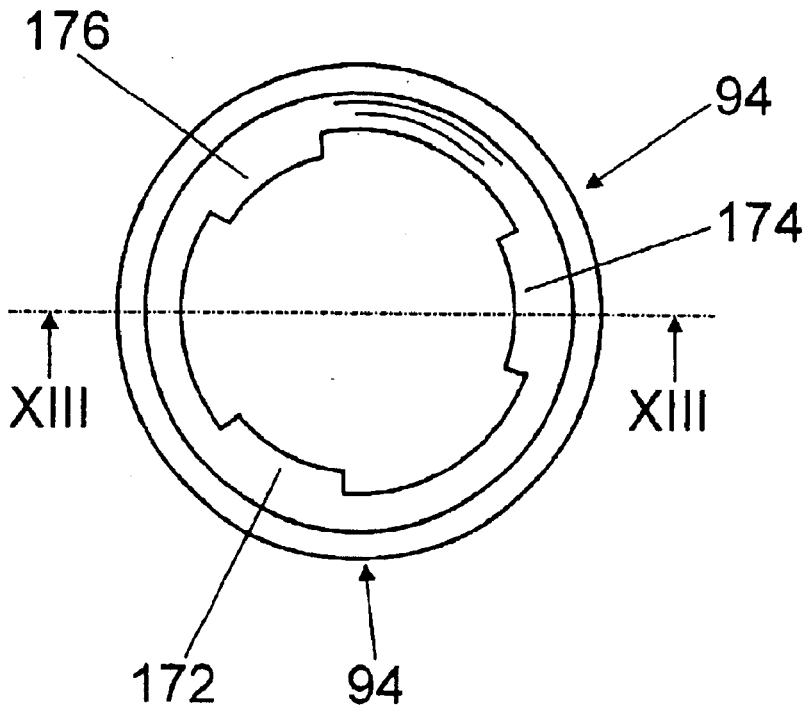
FIG. 12 is a tool hub from FIG. 11 shown from above.
Figure 13:
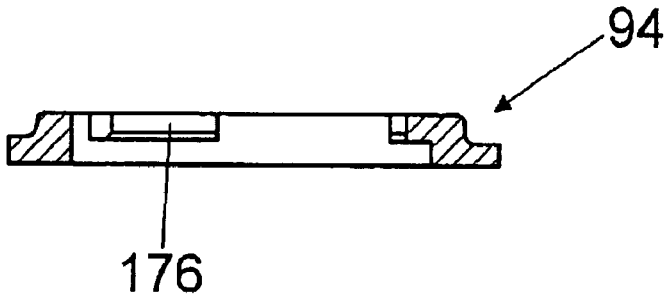
FIG. 13 is a sectional view along the line XIII—XIII in FIG. 12.

The cutoff wheel 32 comprises a ring-shaped sheet-metal hub 94 that is press-moulded with a grinding means 114 on its outer diameter and comprises tongues or spring elements 172, 174, 176 pointing radially outward on its internal diameter (FIGS. 11, 12, and 13). The spring elements 172, 174, 176, in combination with the driving flange 118 and the release button 30, serve to transfer the drive torque, to axially position the cutoff wheel 32, and to secure the cutoff wheel 32 from spinning off when the electric motor is switched on or when the brake is applied to the drive shaft. Moreover, the spring elements, in addition to the segments 122, 124, 126, can be used to center the cutoff wheel 32 to the drive shaft.

When the cutoff wheel 32 is installed, it is oriented on the driving flange 118 in such a fashion that the spring elements 172, 174, 176 on the internal diameter of the sheet-metal hub 94 point into the intermediate spaces 128, 130, 132 between the segments 122, 124, 126 on the driving flange 118. The spring elements 172, 174, 176 of the cutoff wheel 32 lie on the locking segments 152, 154, 156 of the release button 30. The cutoff wheel 32 is then pressed in the axial direction until it reaches the bearing surface 180 of the driving flange 118. The spring elements 172, 174, 176 displace the release button 30 with their locking segments 152, 154, 156 against the spring force of the coil compression spring 22 in the direction 44 axially opposite to the cutoff wheel 32. The locking segments 152, 154, 156 are pressed into recesses 178 of the driving flange 118 (FIG. 18) so that the spring elements 172, 174, 176 come to rest in front of the grooves 134, 136, 138.

The cutoff wheel 32 is thereby centered radially via the centering collar formed by the segments 122, 124, 126. When the cutoff wheel 32 is turned against the driving direction 34, the spring elements 172, 174, 176 grip into the grooves 134, 136, 138 of the driving flange 118. A spring-groove connection is established. The spring elements 172, 174, 176 comprise the length of the grooves 134, 136, 138 in the circumferential direction 36. If the spring elements 172, 174, 176 are pushed into the grooves 134, 136, 138 completely, or if an operating position of the cutoff disk 32 is reached, the detent element 26 snaps into place with its locking segments 152, 154, 156, wherein the coil compression spring 22 presses the detent element 26 with its locking segments 152, 154, 156 into its initial position, so that the locking segments 152, 154, 156 come to rest in front of the grooves 134, 136, 138 once more. The detent element 26, with its locking segments 152, 154, 156, immobilizes the cutoff wheel 32 against the driving direction 34 with positive engagement.

A snap-in noise that is audible to the operator is produced during the snap-in procedure that signals to the user that the snap-in procedure was completed as desired and the tool is ready to use.

The drive torque is transferred with positive engagement via the rotary stops 140, 142, 144 of the driving flange 118 to the spring elements 172, 174, 176 of the sheet-metal hub 94 or the cutoff wheel 32. The cutoff wheel 32 is centered via the centering collar formed by the segments 122, 124, 126 of the driving flange 118 and is held in its axial position by means of the bearing surface 180 and the grooves 134, 136, 138. Moreover, a brake torque occurring during and after the the electric motor is switched off that opposes the drive torque is transferred with positive engagement from the locking segments 152, 154, 156 and the driving flange 118 to the spring elements 172, 174, 176 of the cutoff wheel 32.

A compensation for play is achieved in the axial direction by means of a spring element—not shown in greater detail—formed by a metal strip in the grooves 134, 136, 138. Moreover, a compensation for play could be achieved via other spring elements appearing practical to one skilled in the art, such as via spring-loaded balls that are located in suitable locations of the driving flange and that immobilize the tool hub of the cutoff wheel without play, and/or via a slight oversizing of the spring elements of the tool hub, by means of a slightly wedge-shaped form of the grooves and the spring element of the tool hub, etc.

To release the cutoff wheel 32, the release button 30 is pressed in the axial direction 44 opposite to the cutoff wheel 32. The locking segments 152, 154, 156 of the release button 30 or the detent element 26 are pushed into the recesses 178 of the driving flange 118. The cutoff wheel 32 can then be rotated in the driving direction 34 with its spring elements 172, 174, 176 out of the grooves 134, 136, 138 of the driving flange 118 and removed in the axial direction 38. When the cutoff wheel 32 is removed, the release button 30 is pressed back into its initial position by the coil compression spring 22.

Figure 19:
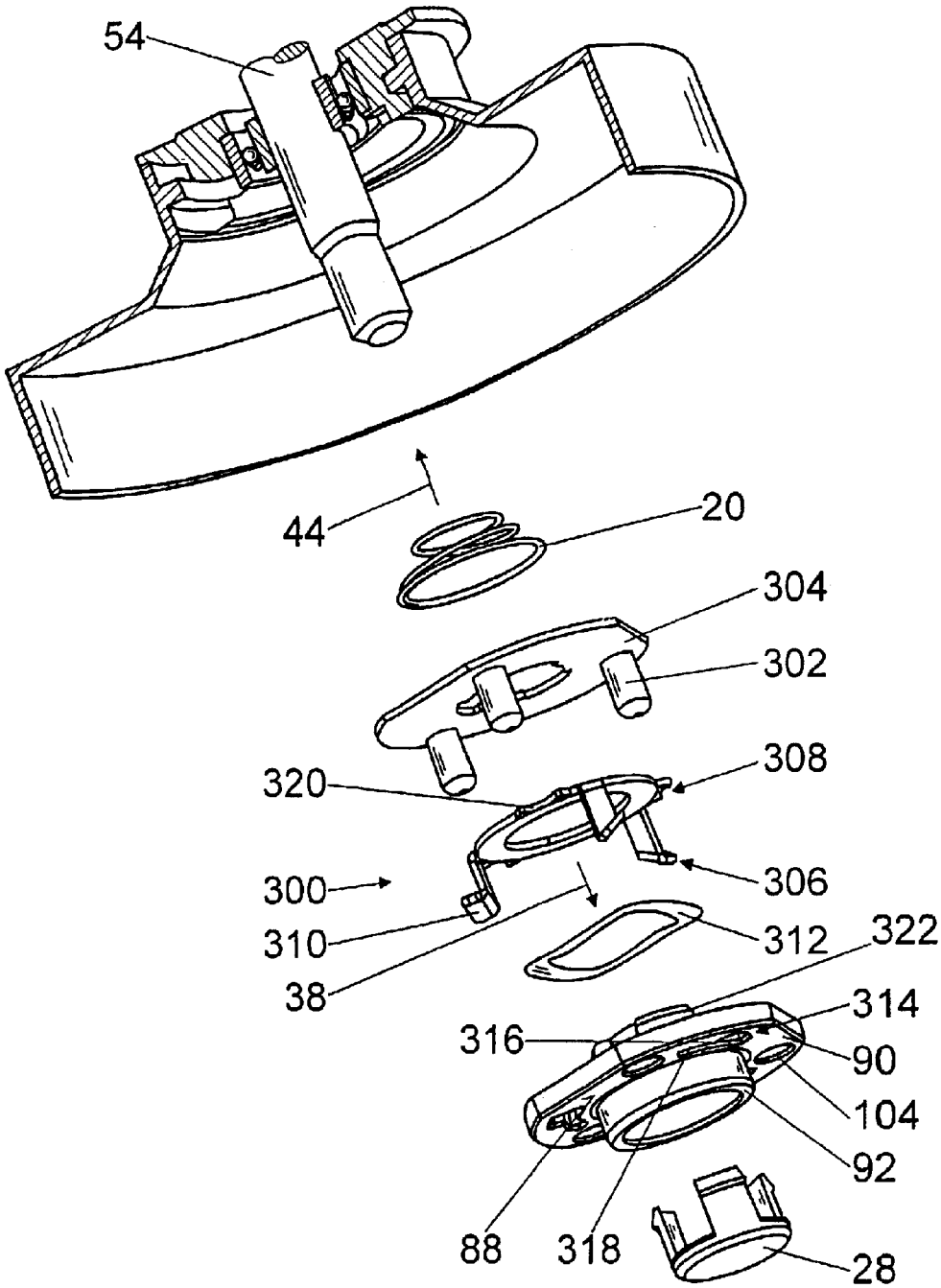
FIG. 19 is an exploded diagram of a variant of FIG. 10.

An exemplary embodiment having a carrier device 300 that is an alternative to the exemplary embodiment in FIG. 10 is shown in FIG. 19. The carrier device 300 comprises a driving flange 90 that forms a bearing surface 88 for a cutoff wheel that is not shown in greater detail. A collar 92 is integrally moulded to the carrier flange 90 on the side facing the cutoff disk, via which the cutoff disk is centered radially with its centering hole in the installed state. Radial forces can be advantageously absorbed by the driving flange 90 without stressing the release button 28.

A sheet-metal plate 308 having three integrally-moulded fastening elements 306 extending in the axial direction 38 and spaced evenly in the circumferential direction are located on a side of the driving flange 90 opposite to the cutoff wheel to lock the cutoff wheel in place axially. The fastening elements 306 are integrally-moulded to the sheet-metal plate 308 in a bending procedure.

Figure 21:
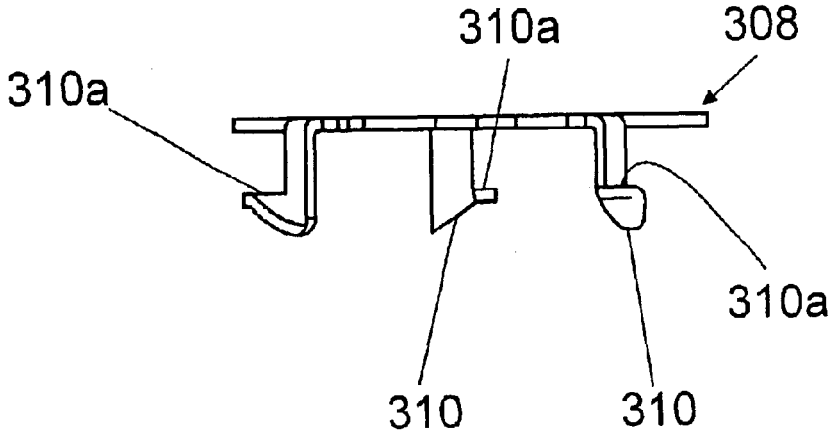
FIG. 21 is a side view of a sheet-metal plate in FIG. 19.
Figure 22:
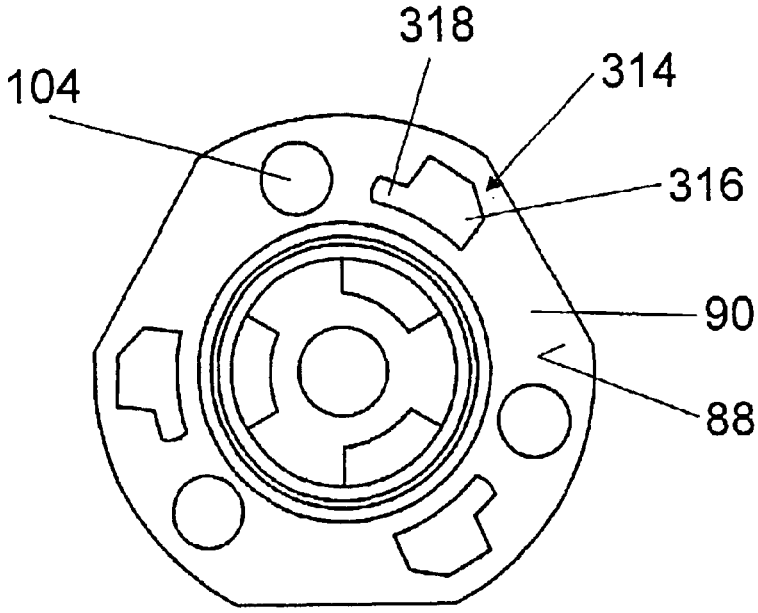
FIG. 22 is a driving flange in FIG. 19 shown from below.

During installation, the driving flange 90, an undulate washer 312, and the sheet-metal plate 308 are preassembled. The undulate washer 312 is thereby slid onto a collar 322 of the driving flange 90 pointing in the direction opposite to the cutoff wheel. The fastening elements 306 of the sheet-metal plate 308, which comprise a hook-shaped extension on its exposed end with an angled surface 310 pointing in the circumferential direction (FIGS. 19 and 21), are guided in the axial direction 38 through recesses 314 in the driving flange 90, in fact, each of them through widened areas 316 of the recesses 314 (FIGS. 19 and 21). By compressing and rotating the sheet-metal plate 308 and the driving flange 90 against each other, the undulate washer 312 is preloaded, and the sheet-metal plate 308 and the driving flange 90 are connected with positive engagement in the axial direction 38, 44, in fact, by the hook-shaped extensions rotating in narrow areas 318 of the recesses 314 (FIGS. 19, 21, and 22). The sheet-metal plate 308 is then supported, loaded by the undulate washer 312, on the bearing surface 88 of the driving flange 90 via edges 310*a* of the hook-shaped extensions that point axially in the direction opposite to the cutoff wheel.

Figure 20:
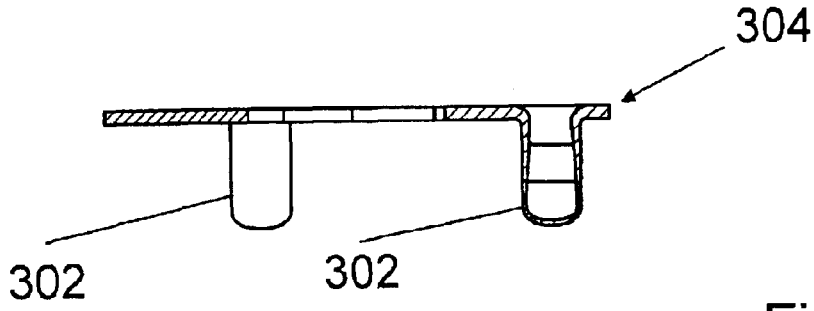
FIG. 20 is a sectional view through a carrier disk in FIG. 19 with integrally-moulded bolts.

After the sheet-metal plate 308 with the integrally-moulded fastening elements 306, the undulate washer 312, and the driving flange 90 are preassembled, a compression spring 20 and a driving disk 304 having three integrally-moulded bolts 302 extending in the axial direction 38 and spaced evenly around the circumference are slid onto a drive shaft 54. The bolts 302 are integrally-moulded to a sheet-metal plate forming the driving disk 304 in a deep-drawing process (FIG. 20).

The preassembled assembly consisting of the sheet-metal plate 308, the undulate washer 312 and the driving flange 90 are then mounted on the drive shaft 54. During installation, the bolts 302 are guided through recesses 320 integrally-moulded on the circumference of the sheet-metal plate 308 and through through holes 104 in the driving flange 90 and grip through the through holes 104 in the installed state. The sheet-metal plate 308 and the driving flange 90 are secured via the bolts 302 against rotating in relation to each other.

The driving flange 90 is pressed onto the drive shaft 54 and then secured with a retaininer ring not shown in further detail. In addition to a compression connection, other connections appearing practical to one skilled in the art are also feasible, such as a threaded connection, etc.

When, during mounting of a cutoff wheel 18 (refer to FIGS. 8 and 10), the hook-shaped extensions of the fastening elements 306 are guided through the wide areas 58, 60, 62 of the slots 64, 66, 68 of the sheet-metal hub 52 (FIG. 19), rotating the sheet-metal hub 52 against the driving direction 34 causes the hook-shaped extensions to be pushed into the curved, narrow areas 70, 72, 74 of the slots 64, 66, 68 of the sheet-metal hub 52. In doing so, the sheet-metal plate 308 with the fastening elements 306 is displaced axially via the angled surfaces 310 against the pressure of the undulate washer 312 in direction 38 until the edges 310a of the hook-shaped extensions come to rest in curved, narrow areas 70, 72, 74 laterally next to the slots 64, 66, 68 of the sheet-metal hub 53. In the installed state, the undulate washer 312 presses the cutoff wheel 18 against the bearing surface 88 via the edges 310*a* of the hook-shaped extensions.

As an alternative, the fastening elements and the slots can be designed rotated by 180° in the sheet-metal hub, so that the mounting direction reverses, and the sheet-metal hub is rotated in the driving direction during mounting. If the fastening elements are designed rotated by 180°, an angled surface of a lower front edge of the fastening element leads during operation, so that injuries by a front edge can be prevented.

| Reference Numerals | |
|---|---|
| 10 | Angle grinder |
| 12 | Carrier device |
| 14 | Carrier device |
| 16 | Carrier device |
| 18 | Application tool |
| 20 | Spring element |
| 22 | Spring element |

-continued

| Reference Numerals | |
|---|---|
| 24 | Detent element |
| 26 | Detent element |
| 28 | Release button |
| 30 | Release button |
| 32 | Application tool |
| 34 | Circumferential direction |
| 36 | Circumferential direction |
| 38 | Direction |
| 40 | Fastener |
| 42 | Fastener |
| 44 | Direction |
| 46 | Recess |
| 48 | Recess |
| 50 | Recess |
| 52 | Tool hub |
| 54 | Drive shaft |
| 56 | Component |
| 58 | Area |
| 60 | Area |
| 62 | Area |
| 64 | Slot |
| 66 | Slot |
| 68 | Slot |
| 70 | Area |
| 72 | Area |
| 74 | Area |
| 76 | Seating surface |
| 78 | Transfer surface |
| 80 | Bearing surface |
| 82 | Component |
| 84 | Recess |
| 86 | Spring element |
| 88 | Bearing surface |
| 90 | Component |
| 92 | Collar |
| 94 | Tool hub |
| 96 | Housing |
| 98 | Handle |
| 100 | Drive housing |
| 102 | Handle |
| 104 | Through hole |
| 106 | Segment |
| 108 | Recess |
| 110 | Circlip |
| 112 | Recess |
| 114 | Grinding means |
| 116 | Centering hole |
| 118 | Driving flange |
| 120 | Thread |
| 122 | Segment |
| 124 | Segment |
| 126 | Segment |
| 128 | Intermediate space |
| 130 | Intermediate space |
| 132 | Intermediate space |
| 134 | Groove |
| 136 | Groove |
| 138 | Groove |
| 140 | Rotary stop |
| 142 | Rotary stop |
| 144 | Rotary stop |
| 146 | Snap-in peg |
| 148 | Snap-in peg |
| 150 | Snap-in peg |
| 152 | Locking segment |
| 154 | Locking segment |
| 156 | Locking segment |
| 158 | Recess |
| 160 | Recess |
| 162 | Recess |
| 164 | Bearing surface |
| 166 | Bearing surface |
| 168 | Bearing surface |
| 170 | Projection |
| 172 | Spring element |
| 174 | Spring element |
| 176 | Spring element |

-continued

| Reference Numerals | |
|---|---|
| 178 | Recess |
| 180 | Bearing surface |
| 182 | Carrier device |
| 184 | Carrier device |
| 186 | Application tool |
| 188 | Application tool |
| 190 | Detent element |
| 192 | Detent element |
| 194 | Detent element |
| 196 | Detent element |
| 198 | Detent element |
| 200 | Detent element |
| 202 | Carrier element |
| 204 | Carrier element |
| 206 | Carrier element |
| 208 | Carrier element |
| 210 | Carrier element |
| 212 | Carrier element |
| 214 | Carrier element |
| 216 | Slot |
| 218 | Slot |
| 220 | Slot |
| 222 | Slot |
| 224 | Slot |
| 226 | Transfer surface |
| 228 | Component |
| 230 | Component |
| 232 | Bearing surface |
| 234 | Component |
| 236 | Recess |
| 238 | Area |
| 240 | Area |
| 242 | Area |
| 244 | Area |
| 246 | Area |
| 248 | Area |
| 250 | End position |
| 252 | End position |
| 254 | End position |
| 256 | Driving flange |
| 258 | Thread |
| 260 | Face |
| 262 | Collar |
| 264 | Bearing surface |
| 266 | Centering collar |
| 268 | Centering hole |
| 270 | Area |
| 272 | Area |
| 274 | Area |
| 276 | Lug |
| 278 | Seating surface |
| 300 | Carrier device |
| 302 | Detent element |
| 304 | Component |
| 306 | Element |
| 308 | Component |
| 310 | Angled surface |
| 310a | Edge |
| 312 | Spring element |
| 314 | Recess |
| 316 | Area |
| 318 | Area |
| 320 | Recess |
| 322 | Collar |

What is claimed is:

1. Tool receiver for a grinder, in particular for a handheld angle grinder (10), having a carrier device (300) via which an application tool (18) can be connected to a drive shaft (54) of the grinder (10); said carrier device (300) comprising at least one detent element (302), whereby said detent element (302) can be moved against a spring force and said detent element (302) snaps into place in an operating position of the application tool (18) driven by said spring force in order to immobilize said application tool (18) in a circumferential direction, wherein the carrier device (300) comprises at least a second element (306) and a first spring element (312), whereby the second element (306) is separate from said detent element (302) and is designed to connect the application tool (18) in an axial direction (44, 38) to the drive shaft (54) and whereby the first spring element (312) is designed to exert an axial force on the application tool (18) via the second element (306).

2. Tool receiver for a grinder according to claim 1, wherein said spring force acts in the axial direction (36).

3. Tool receiver for a grinder according to claim 1, wherein said first spring element (312) is realized as an undulate washer.

4. Tool receiver for a grinder according to claim 1, wherein said axial force pulling the application tool (18) towards a body of the grinder (10).

5. Tool receiver for a grinder according to claim 2, wherein said spring force is generated by a second spring element (20) separate from the first spring element (312).

6. Tool receiver for a grinder according to claim 1, wherein said first spring element (312) is preloaded during a connecting movement of said application tool (18) relative to the carrier device (300).

7. Tool receiver for a grinder according to claim 4, wherein said carrier device (300) comprising an angled surface (310) used to preload said first spring element (312) during the connecting movement.

8. Tool receiver for a grinder according to claim 4, wherein said first spring element (312) is preloaded during a part of the connecting movement directed in a circumferential direction.

9. Tool receiver for a grinder according to claim 1, wherein said first spring element (312) blocks in the operating position of the application tool (18).

10. Tool receiver for a grinder according to claim 1, wherein the detent element (302) can be released from its locked position using a release button (28).

11. Tool receiver for a grinder according to claim 1, wherein the second element (306) is designed to be hooked into a recess (314) in the application tool (18).

12. Tool receiver for a grinder according to claim 1, wherein at least one detent element (302) is integrally molded on a discoid component (304).

13. Tool receiver for a grinder according to claim 2, wherein at least two elements (306) for immobilizing the application tool (18) in the axial direction are integrally molded to a discoid component (304).

14. Application tool having a tool hub (52) that can be effectively connected to carrier device (300) and to a drive shaft (54) of a grinder (10), said tool hub (52) having at least one recess (46, 48, 50) designed to receive a detent element (302) of the carrier device (300) fixing the application tool in a circumferential direction to the drive shaft (54), wherein the tool hub (52) has at least a second recess (64, 66, 68) designed to engage with a second element (306) of the carrier device, said second element (306) fixing the tool hub (52) in an axial direction (44, 38) to said drive shaft (54).

15. Application tool according to claim 14, wherein at least one of maid recesses (64, 66, 68) is formed by a slot that comprises a wide area (58, 60, 62) and at least one narrow area (70, 72, 74).

16. Application tool according to claim 14, wherein the tool hub (52) has a third recess (116) for centering, which is separate from the first and the second recesses (46, 48, 50, 64, 66, 68).

* * * * *